US005445516A

United States Patent [19]

Stouffer

[11] Patent Number: 5,445,516

[45] **Date of Patent: * Aug. 29, 1995**

[54] BURNER METHOD AND APPARATUS HAVING LOW EMISSIONS

[75] Inventor: Ronald D. Stouffer, Silver Spring, Md.

[73] Assignee: Bowles Fluidics Corporation, Columbia, Md.

[ * ] Notice: The portion of the term of this patent subsequent to Sep. 22, 2009 has been disclaimed.

[21] Appl. No.: 260,441

[22] Filed: Jun. 15, 1994

Related U.S. Application Data

[63] Continuation-in-part of Ser. No. 50,385, May 12, 1993, a PCT/US92/0446, filed Jan. 24, 1995, Pat. No. 5,383,781, Ser. No. 77,197, Jun. 16, 1993, abandoned, and Ser. No. 216,522, Mar. 23, 1994, said Ser. No. 50,385, is a continuation-in-part of Ser. No. 710,024, Jun. 6, 1991, Pat. No. 5,149,263.

[51] Int. Cl.[6] ..... F23C 5/00

[52] U.S. Cl. ..... 431/8; 431/127; 431/252; 431/354; 431/344; 239/11; 239/589.1

[58] Field of Search ..... 431/2, 1, 344, 127, 431/252, 350, 354, 353, 8, 91, 160; 239/589.1, 11, 310, 727, 101; 137/835, 820

[56] References Cited

U.S. PATENT DOCUMENTS

| | | | |
|---|---|---|---|
| 2,601,893 | 7/1952 | Funke | 431/91 |
| 3,038,530 | 6/1962 | Fowler | 431/91 |
| 3,759,245 | 9/1973 | Greco, Sr. | 126/406 |
| 4,052,002 | 10/1977 | Stouffer et al. | 239/4 |
| 4,508,267 | 4/1985 | Stouffer | 239/11 |
| 4,955,547 | 9/1990 | Woods | 239/589.1 |
| 5,149,263 | 9/1992 | Stouffer | 431/2 |

*Primary Examiner*—Larry Jones
*Attorney, Agent, or Firm*—Jim Zegeer

[57] ABSTRACT

A low NOx gas burner for heating objects having a supply of gas under pressure which is to be mixed to achieve a combustible mixture, gas flow line connecting to said burner to said supply, a burner means for mixing air with said fluid fuel to achieve said combustible mixture, characterized by said burner means includes one or more jet forming means for issuing one or more jets of said gas having a given cross-sectional area and sweeping said one or more jets of gas in ambient air downstream of said burner means to mix air with said gas and achieve said combustible mixture a distance spaced from any physical structure of said burner means whereby a flame front of burning combustible mixture has a broad shape and is spaced a predetermined distance from said burner.

28 Claims, 13 Drawing Sheets

(SECTION AA)

BURNER METHOD AND APPARATUS HAVING LOW EMISSIONS

REFERENCE TO RELATED APPLICATIONS

This application is a continuation-in-part of application Ser. No. 08/050,385, a PCT/US92/0446, filed Jan. 24, 1995, now U.S. Pat. No. 5,383,781 (which is based on International application PCT/US92/04446), which is a continuation-in-part of Ser. No. 710,024, filed Jun. 6, 1991, now U.S. Pat. No. 5,149,263, and is a continuation-in-part of application Ser. No. 08/077,197, filed Jun. 16, 1993, now abandoned, and a continuation-in-part of application Ser. No. 08/216,522, filed Mar. 23, 1994.

BACKGROUND AND BRIEF DESCRIPTION OF THE INVENTION

The present invention relates to burner method and apparatus having low emissions and, more particularly, to a natural gas burner having low emissions.

The current class of burners, known as blue flame burners, typically have NOx emissions at the 110 ppm level. It has been proposed that the emission requirement be ratcheted downwardly. Only "exotic" burners using blowers to supply 100% air premix (e.g., the upstream addition of primary air) have NOx emissions low enough to meet the proposed standard. Such burners require expensive additional equipment and controls to accomplish this performance which add significant costs to the burner. Other blue flame burners have lowered their NOx emissions by adding inserts in the combustion area to make the flame burn cooler. It has been found that lowering NOx has been typically at the expense of higher CO emissions.

The range of application of the invention is wide, ranging from domestic uses such as in water heaters (residential and commercial), central heating furnaces, gas boiler, wall furnaces (vented, residential), room heaters (vented and unvented), ranges/ovens, dryers, to industrial uses such as industrial burners, dryers, heat and steam generators drying and finishing reactors, curing ovens, etc.

In conventional propane gas torches the burner nozzle has a chamber for mixing the stoichiometric ratio necessary to achieve a blue flame which has a point of highest temperature to be the most efficient use of fuel. Heating of an object having a large surface area requires passing the torch flame tip back and forth over the area or using a diffusing nozzle to heat it somewhat uniformly.

According to the present invention, a fluidic oscillator incorporated in the burner nozzle sweeps the jet of fuel, which may be somewhat internally mixed with air inside the mixing chamber but most or all of the mixing with air is achieved outside of and downstream of the nozzle and within a predetermined distance. The swept jet of fuel mixes with air in the space beyond or downstream the outlet opening so that upon combustion it produces a flame front having an area and thickness determined by the sweep angle and wave pattern of the fluidic oscillator and the rate of mixing proportional to frequency of oscillation is self-regulating to achieve a proper fuel-air ratio needed for full combustion. A wide variety of fluidic oscillators are known and useful in practicing of the invention.

Since burners incorporating the invention do not require pre-mix (the addition of primary air), it can be added to existing systems. Advantages of the invention include low NOx emissions over a wide firing range (and without the addition of primary air upstream of where the jet is swept); the shape of the hot flame front is expanded and spaced from the physical burner nozzle to achieve a high heat transfer efficiency; low cost; a cooler flame; and, the physical nozzle remains relatively cool and thus in some applications can be made from low melting temperature materials such as plastic or other low melting material. Moreover, by providing oscillators with different frequency of oscillation, and wave patterns, the distance of the flame front and the shape thereof can be adjusted to accommodate different use services or applications.

Almost any fluidic oscillator in which the fuel can be formed into an oscillatable, deflectable or sweepable jet e.g., a jet that is oscillated or swept from its normal path and at a rate sufficient to achieve proper mixing of fuel to be combustible a predetermined distance from the nozzle, can be used. Such devices as shown in U.S. Pat. No. 4,052,002 for controlled fluid dispersal techniques, Bray U.S. Pat. Nos. 4,463,904 and 4,645,126, Stouffer U.S. Pat. No. 4,508,267 and Stouffer and Bauer U.S. Pat. No. Re. 33,158 are useful. In the preferred embodiment, it is desired to achieve as much external mixing of the fuel with air as is possible so as to have as large a detached flame front as possible. Where uniformity across the flame front is desired, then an oscillator with little or no dwell at the ends of sweeping the jet can be used. In some cases, fluidic oscillators having diverging outlets sweep the fuel jet back and forth and entrain some air into the nozzle and hence these are likewise useful but do not have as large a spacing between the flame front and the nozzle because there is less external mixing of fuel with air to achieve the stoichiometric ratio.

Back and forth sweeping paths, circular (helical) as well as complex sweep patterns can be used in gas burners incorporating the invention.

In tests on a natural gas burner incorporating the invention wherein an oscillator of the type shown in Stouffer U.S. Pat. No. 4,508,267 was utilized, the firing rate was varied by a factor of about 1.7 (4.9 to about 8.4 KBTU/hr), burner-inlet pressure by a factor of about 2.67 (2.4 to about 6.4 in). Despite these changes in burner operating conditions, average $O_2$-free $NO_X$ emissions varied only by $\pm 6$ ppm, or $\pm 6.25\%$, which is about the uncertainty of the measurement. This narrowness in the distribution in the data suggests that NOx and CO emissions from the burner of the present invention are not a strong function of turndown ratio or primary aeration, which is unique among burners. Explanation of normalization of the emission samples: A sample is taken of the burned gases at some distance from the combustion area. In order to account for the dilution of sample by fresh air, the $CO_2$ and $O_2$ content of the sample is measured along with the NOx and CO. The measured fraction of pollutant emissions is then adjusted to a value it would be had the sample been taken at the combustion area where it is assumed to be $O_2$-free. The same can be done using $CO_2$. Theoretically, these two methods would lead to the same adjustment factor, but where there is conflict, the $O_2$ normalized value is used. Sometimes this adjusted value is referred to as "air-free," but this is a misnomer since $O_2$-free is what is meant.

Putting the emissions into perspective, a "typical" vented gas appliance, if such could be defined, has NOx emissions on the order of about 110 ppm. Hence, use of the burner nozzle of this invention in such a gas appliance has the potential of reducing NOx emissions by at least about 50%.

DESCRIPTION OF THE DRAWINGS

The above and other objects, advantages and features of the invention will become more apparent when considered with the following specification and accompanying drawings wherein:

FIGS. 6*a*, 6B-1, 6B-2, 6C, 6D, 6E and 6*f*, are diagrammatic illustrations of various fluidic oscillator silhouettes useful in practicing the invention.

DETAILED DESCRIPTION OF THE INVENTION

Figure 1:
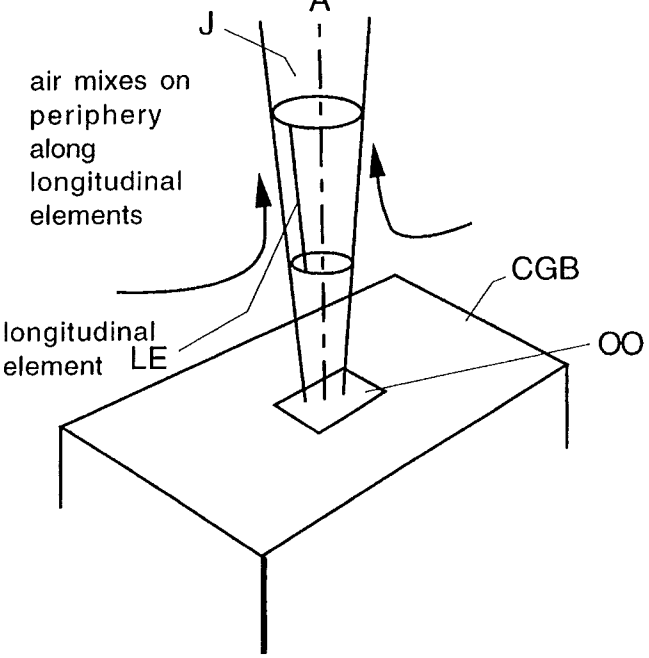
FIG. 1 (PRIOR ART)
FIG. 1 is a diagrammatic illustration of a prior art unswept jet burner.

FIG. 1 illustrates a normal, non-oscillating or non-swept jet "J" issuing from the outlet orifice OO (shown as square or rectangular, but can be round or oval) of conventional gas burner nozzle CGB and propagates on an axis A coincident with the nozzle axis. Air mixes on the periphery along longitudinal elements LE. The conventional burner jet of FIG. 1 is called a diffusion flame because the mixing with ambient air occurs only on the periphery so that the gas jet burns from the outside in.

Figure 2B:
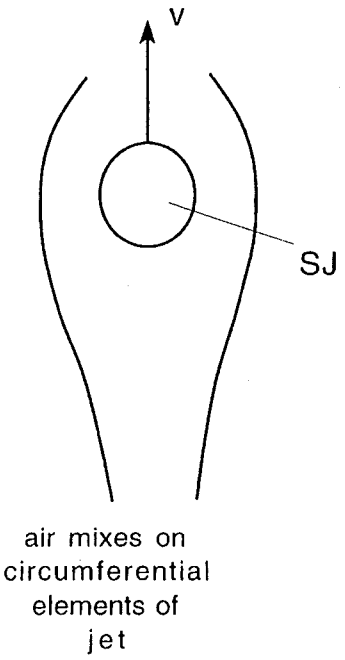
FIG. 2*b*–2*d* are an explanatory illustrations of the air mixing action in burners incorporating the invention.
Figure 2A:
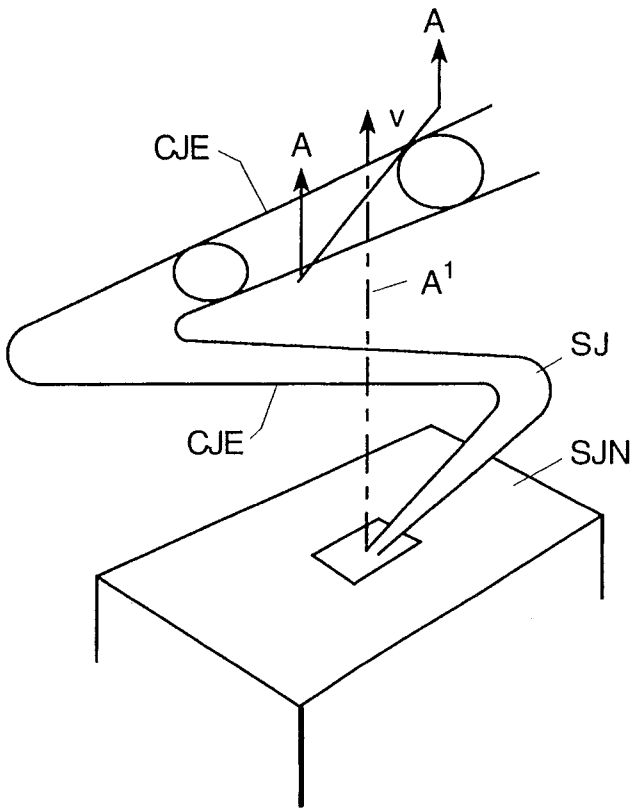
FIG. 2*a* is a diagrammatic illustration of a swept jet burner incorporating the invention.

In contrast, sweeping jets as soon in FIG. 2*a* propagate with their axis transverse to the nozzle SJN axis A1. The sweeping jet SJ issuing from nozzle SJN is juxtapositioned essentially transversely to the nozzle axis A1 so that the swept gas jet SJ mixes with ambient air along circumferential jet elements CJE as shown in FIG. 2B. The gas-air mix involves much more of the jet cross-section promoting more thorough mixing, lower NOx emissions, a cooler flame and improved thermal efficiency.

AN INTERMITTENT JET ANALOGY

Figure 2C:
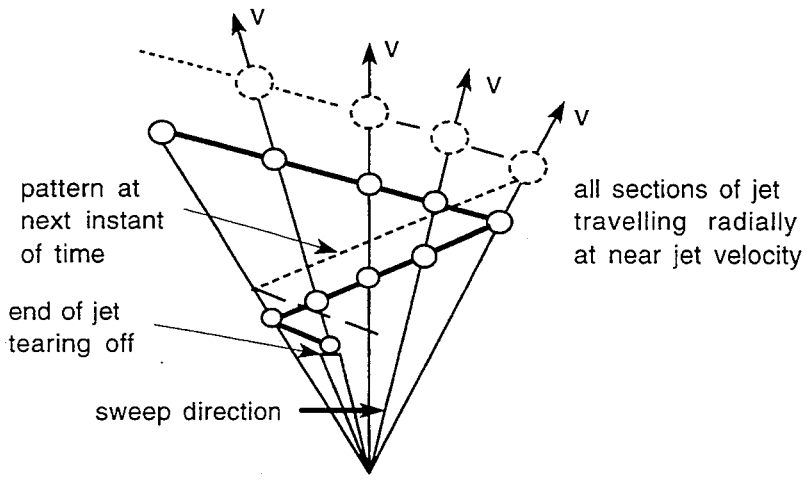

So as to facilitate thinking about the essential characteristics of sweeping jets, consider the jet to break off in discrete puffs of gas as it sweeps. In FIG. 2*c*, these puffs of gas are represented as spheres separated by spaces to further facilitate the thought process, even through it is known that the wave pattern is truly a continuum.

Note that all puffs of gas travel along radial paths at near jet velocity, so that progressively the puffs become more separated. Also, because of gas expansion and mixing with the ambient air, they become progressively larger. The pattern, although expanding, maintains its characteristic shape for many wavelengths downstream.

A normal, non-sweeping jet is represented by the trail of puffs along the centerline of wave pattern (shown in FIG. 2C). A comparison suggests that there are more puffs in the sweep pattern than the straight jet per unit of time.

Figures 2, 2C:
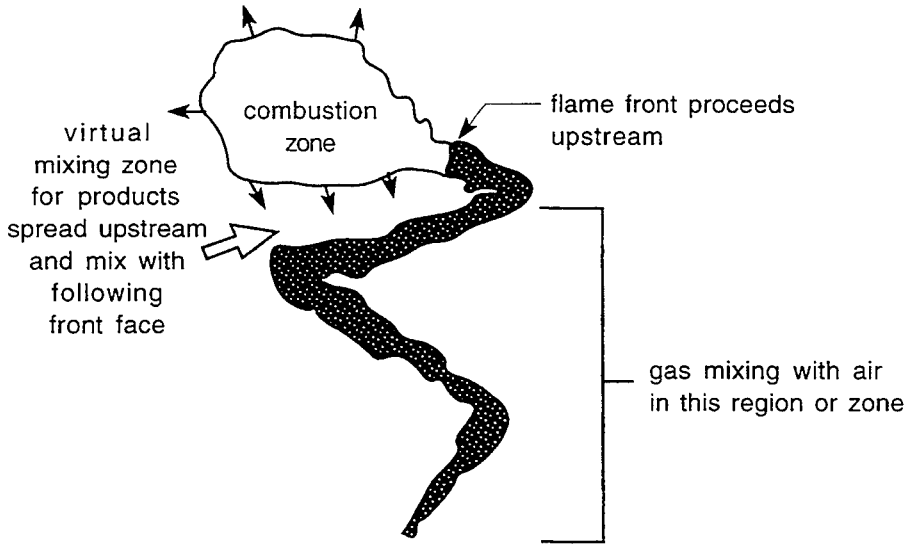
Figures 2, 2C, 3:
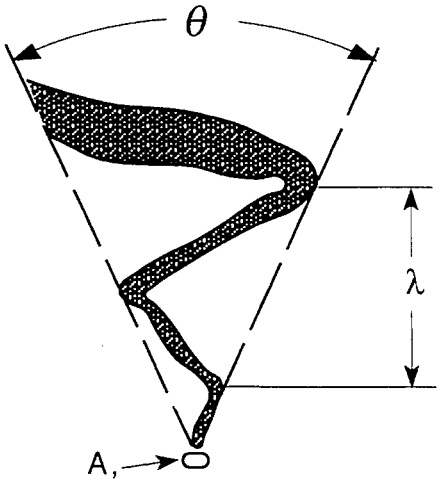
Figure 2D:
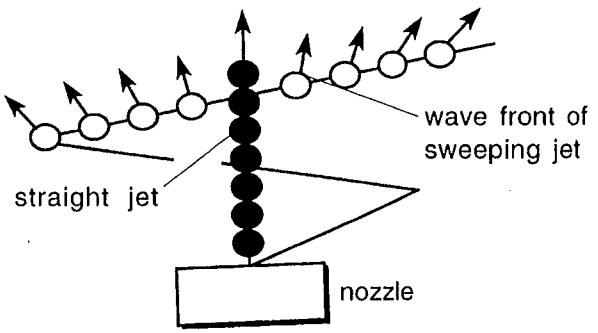

FIG. 2*d* compares the straight jet's path through the ambient with the path of a wave front of the sweeping jet. The puffs of gas in the wave front have more exposure to the ambient than do the puffs in the straight jet. The puffs in the straight jet have less exposure to the ambient because of the shielding provided by the preceding puff, whereas the wave front puffs are individually exposed to the ambient by virtue of their alignment and because they are progressively separating from each other.

GAS NOZZLE DESIGN FOR VARIOUS WAVELENGTH PER FLAME GAP

Figure 10:
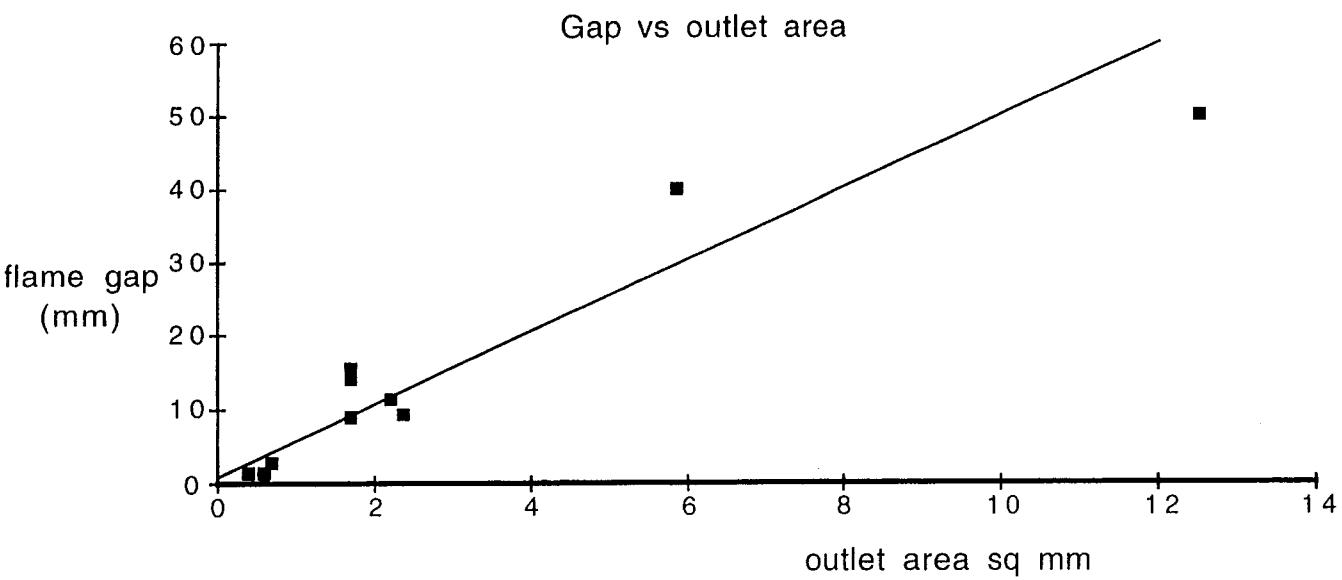
FIG. 10 is a graph plotting flame gap vs. outlet area.

It has also been found that the flame gap depends solely on the area of the output jet. This linear relationship (shown in FIG. 10) can be stated as:

$$G = K_g A_{pn}$$

where $G$ = flame gap $K_g$ = constant $A_{p.n.}$ = power nozzle area = (width X depth)

It is known that some other characteristics of fluidic oscillators concern the wavelength and frequency. First, the frequency f is dependent on the type of oscillator, its size, and is linearly proportional to the jet velocity v.

$$f = \frac{K_f}{w} * v$$

where

Kf=constant for a given type of osc (see table below)

| TYPE OF OSCILLATOR | RELATIVE VALUE OF Kf FOR w = 1 |
|---|---|
| inertance loop (FIG. 6a) | 0.5 |
| feedback (FIGS. 6b, 6c) | 1.0 |
| OI (002) (FIG. 6e) | 2.0 |
| island (FIG. 6d) | 8.0 |

The wavelength λ is:

$$\lambda = \frac{v}{f} = \frac{v}{K_f v} w = \frac{w}{K_f}$$

The flame gap G is:

$$G = K_g A_{pn} = K_g wd$$

So that the ratio of flame gap to wavelength is:

$$\frac{G}{\lambda} = \frac{K_g wd}{w} Kf = K_g K_f d$$

Therefore the number of wavelengths within a gap length is dependent on the power nozzle depth and the type of oscillator. Of these two influences, the type of oscillator is the stronger. The table above for Kf shows that the island oscillator (FIG. **6*d*) would produce the largest number of wavelengths in the gap, with the oscillator of FIG. 6*e*** type silhouette having the second largest number.

CONSTANT WAVE PATTERN

It has been learned that both the wavelength and the waveform of a given sweeping jet oscillator design are constant over a wide range of flow rates. It is believed that the wavelength is constant because both the propagation velocity v and the frequency f are linear functions of the jet velocity $v_j$:

$$\lambda = \frac{v}{f} = \frac{k_v V_j}{k_f v_j} = \frac{k_v}{k_f} = \text{const}$$

CONSTANT WAVEFORM

It has been observed that the waveform is the same at different flow rates as we view liquid stream patterns with the aid of a strobe light. As the flow rate is changed, the identical wave shape reappears after adjusting the strobe to the new sweep frequency.

WAVELENGTH AND FORM IDENTICAL FOR GASES AND LIQUIDS

It has been found that the sweep frequency is the same for gases and liquids which have equal volumetric throughputs as long as the gas is in the incompressible flow regime (supply pressure less than 15 psig for air). Therefore, since the velocities are the same (equal flow rates), equal frequencies means that the wavelength and waveform are the same.

The importance of this is that physical measurements are so much easier for liquids owing to the inherent ability to directly observe them.

FLAME GAP vs. GAS JET AREA

Experiments were conducted where six fluidic sweep oscillators for various types and sizes were measured for wavelength, frequency, and flow rate at a constant supply pressure. These same nozzles were then tested with natural gas and their flame gaps measured. As can be seen from the chart below, the wavelength and frequency have no recognizable relationship to the flow rate.

| Sample Identification | ml/in @ pig | frequency cps | wavelength mm | flame gap mm |
|---|---|---|---|---|
| FB + rnd interact | 98 | 5600 | 25 | 14 |
| FB + isld after outlet | 57 | 4400 | 20 | 2 |
| FB + isid before outlet | 55 | 5650 | 10 | 1 |
| FB +isld before outlet | 388 | 4950 | 30 | 1 |
| saturn-FB + no isld | 1920 | 1080 | 30 | 8 |
| island osc | 540 | 10500 | 25 | 50 |
| island osc | 1120 | 1770 | 17 | 20 |

But when the flame gap is plotted vs the flow rate (at constant supply pressure), a clear, linear relationship becomes evident.

The flow rate Q is related to the jet velocity $v_i$, $$Q = A_{eff} v_j$$

where $A_{eff}$=effective jet area

So we can view the abscissa of the graph above as $A_{eff}$ instead of Q since:

$$Q/V_j/Q = A_{eff}$$

Note that the jet velocity is constant since the supply pressure was held constant. This result means that the flame gap is a function of the size of the cross-section of the gas jet rather than related directly to specific characteristics of the wave pattern such as wavelength.

NOx REDUCING METHOD

There are two recognized and well documented methods of reducing NOx and CO emissions, which are referred to as staged combustion.

In one case, the so-called reburn method, products of a first combustion are injected with fuel so that a second combustion results in lowered emissions.

In the other case, called the vitiated air method, the products of combustion are mixed with the gas and air supplied to itself, thereby reducing the flame temperature and producing lowered emissions.

Normally these NOx reducing methods are staged, i.e., they are executed at two different points in the combustion process and therefore are also separated in time. This separation in time is critical so as to allow time for sequential combustion to take place.

In the current invention, the dynamic behavior of the traveling wave pattern provides the essential elements for staged combustion.

In FIG. 2C-2, the traveling wave is shown at one instant of time where the leading wave front is burning with its flame front moving upstream along the wave front, to the right. The trailing wave front's products of combustion move toward the following front face in the interspace between them because of the velocity imparted by the expanding hot gases (e.g., products of combustion and unburned $N_2$, etc.)

At the same time, the trailing front face of mixed air and gas is also expanding because of the shear effect of the gas pattern traveling through air of lesser velocity, creating turbulent mixing and dispersion.

So, from the standpoint of the leading wave front, its products of combustion are being injected with fresh gas and air and then heated combustion as in the reburn case. While, viewed from the trailing (to be burned) wave front, it is being supplied by products of a former combustion and is burning gas and vitiated air as in the second NOx reduction method.

Therefore, the two NOx reducing methods are both operating in the instant invention and work cooperatively to achieve the low emission burning.

The wavelength, in designing for low emissions, is difficult to adjust, without disturbing other desirable characteristics. The area of the jet is somewhat limited by flame arresting sizes at the lower end and desirable flame minimum size at the other. The fan angle is very easy to adjust and has the most latitude relative to other requirements.

Figure 3A:
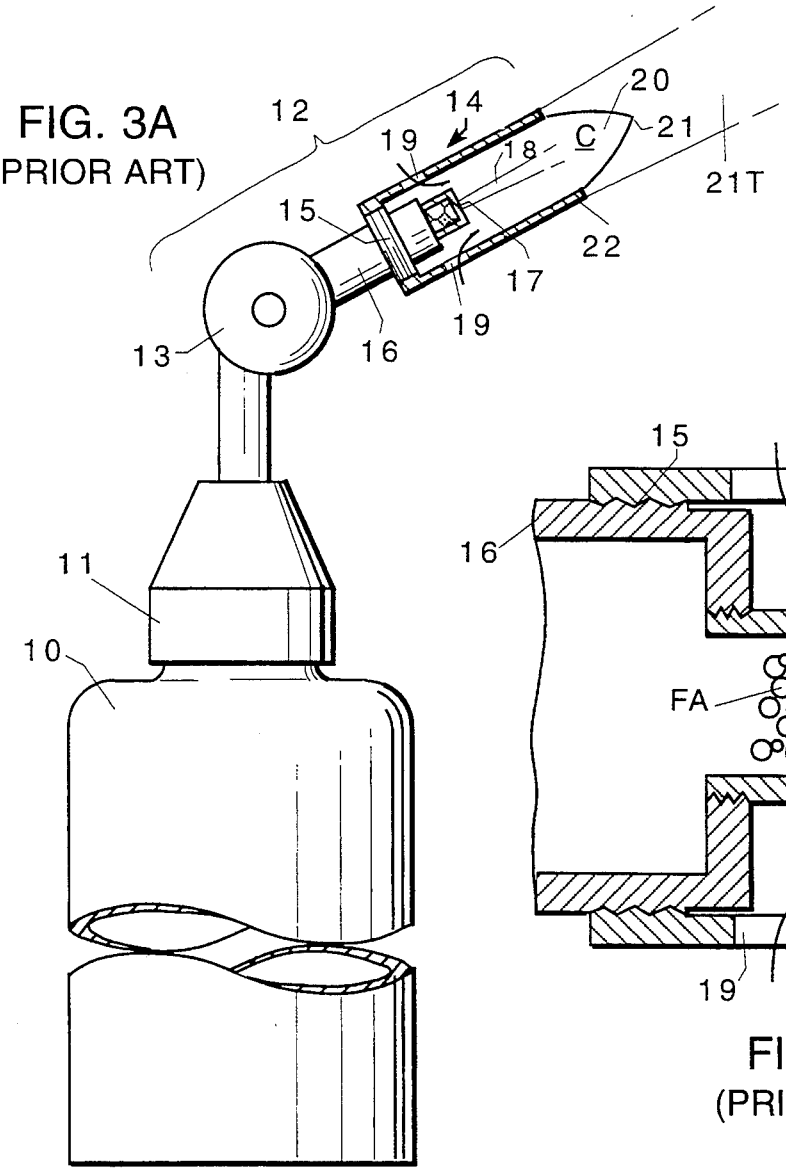
FIG. 3A (PRIOR ART)
FIG. 3*a* is a diagrammatic perspective view of a conventional prior art propane torch.
Figure 3B:
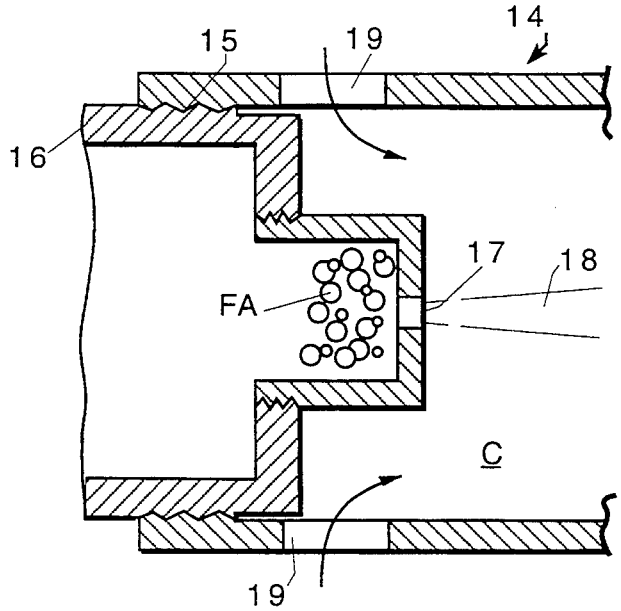
FIG. 3B (PRIOR ART)
FIG. 3*b* is an enlarged view of the nozzle.

The conventional propane torch illustrated in FIG. 3*a* is mounted on a FUEL tank 10 through a conventional threaded fitment 11 securing the torch 12 to tank 10. It will be appreciated that flexible tubing, pressure gauges, regulators and like arrangements may be likewise utilized. A valve 13 controls the flow of fuel (propane in this embodiment) from propane tank 10 to the torch nozzle proper 14. Torch nozzle proper 14 is threadably secured to the threaded end 15 of pipe 16. An aperture or orifice 17 (typically about 0.003" in diameter) issues a jet of propane fuel into a chamber 18 which is provided with a series of openings 19 through which air is entrained by the flow of jet 18 into chamber C. By adjusting the valve 13, the proper air/fuel ratio is achieved so that a well defined blue flame 20 having a tip 21 with a trailing transparent flue flame portion 21T is achieved. The spacing of the flame front 20 from the nozzle end 22 is in most cases nonexistent. Thus, the nozzle 14 typically will heat up.

Figure 3C:
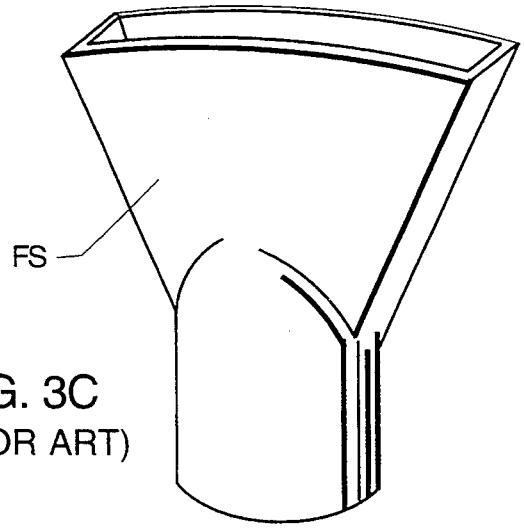
FIG. 3C (PRIOR ART)
FIG. 3*c* is a flame spreader.

Most importantly however is that the flame front 20 is elongated into a tip having a typical "flame" shape with which the hot spot is around approximate the tip 21. A flame diffuser or spreader FS (FIG. 3*c*) can be attached to the end of the chamber C to broaden the flame. The device shown in FIG. 3*a* includes a conventional safety device such as a flame arrester FA such that when the fuel pressure drops to such a low level that it is not able to project beyond the confines of the device, the flame does not spread back to ignite fuel in the tank.

There are numerous other prior art systems, in some of which air is entrained through an opening in pipe 16, for example, and premixed with air so that in the torch chamber C itself, less air is required to be entrained to achieve a proper fuel-air ratio to support combustion.

Figure 4:
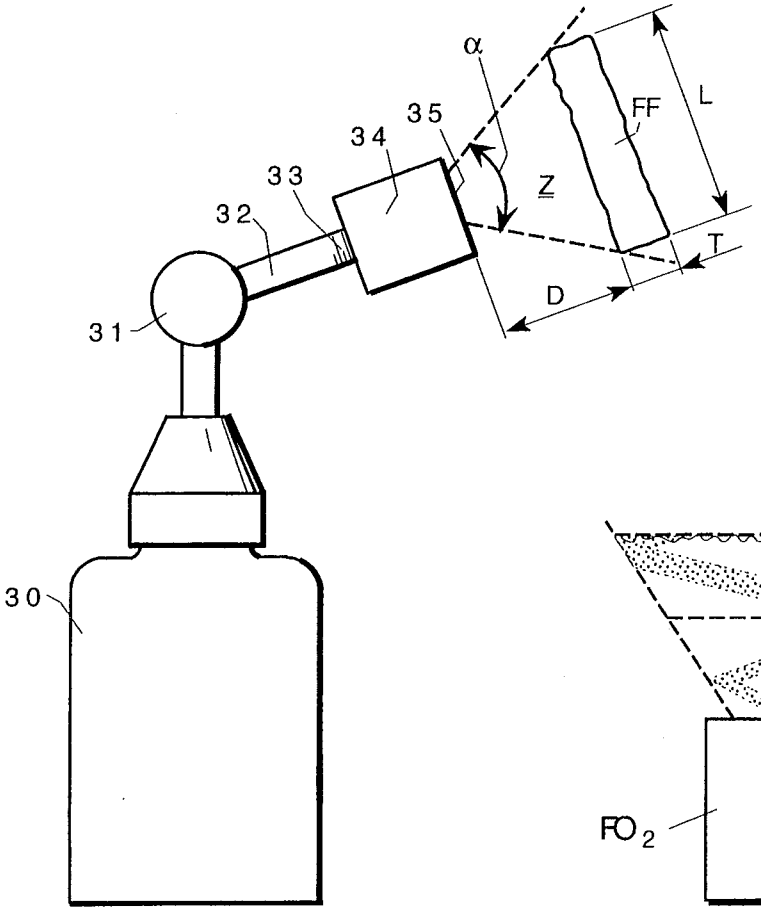
FIG. 4 is a generalized diagrammatic illustration of a propane burner nozzle incorporating the invention showing the sweeping jet and the detachment of the flame front with the distance or gap between the flame front and the nozzle forming a mixing area for achieving the stoichiometric gas/air mixture for proper combustion.

Referring now to FIG. 4, a fuel tank such as a propane tank 30 and valve 31 has tube or pipe 32 (which is identical to tube or pipe 16 and also may include the conventional premix entrainment orifices and the like as well as the safety devices described above) is fitted on its threaded end 33 with a fluidic oscillator nozzle 34 which produces a jet of fuel which is swept through an angle ($\alpha$) in a mixing zone Z to support a combustion flame front FF which is spaced a distance D from the end 35 of fluidic oscillator nozzle 34. This distance D and the shape of the flame front FF are significant improvements achieved by the present invention. Sweeping the jet stream of fuel through the angle ($\alpha$) and at a predetermined rate (for example, about 1 to 3 kHz) results in an efficient mixing with air to achieve the proper fuel-air mixture at a distance D downstream of the nozzle so as that the nozzle itself will remain cool and the flame front FF can be shaped to be a broad hot flame front. Thus, instead of having to oscillate the nozzle back and forth to heat-up a broad surface area, the nozzle is held stationary and the flame front is shaped to have a length L and the thickness T. Thus, in comparison to the flame front for the conventional torch, the present invention provides a broad area flame front which is significantly spaced from the nozzle so that the nozzle remains essentially cool (radiant heat reflected from a heated object, of course can heat the nozzle) but is counteracted by cool, expanding fuel making the nozzle more efficient (because inter alia the heat from the torch itself is supplied to the object rather than to heating-up the nozzle).

Figure 5A:
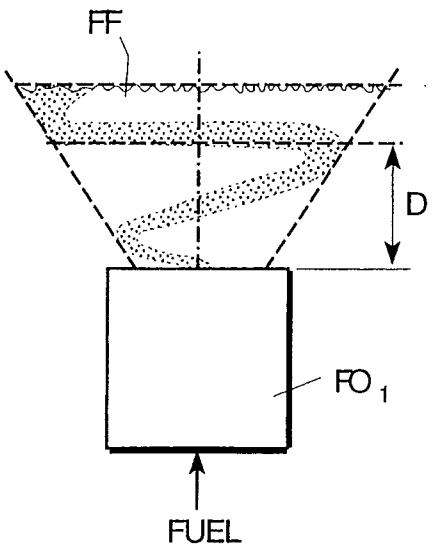
FIGS. 5*a*, 5*b*, 5*c*, 5*d* and 5*e* are diagrammatic illustrations of various fluidic oscillator wave shapes which are useful in practicing the invention.
Figure 5B:
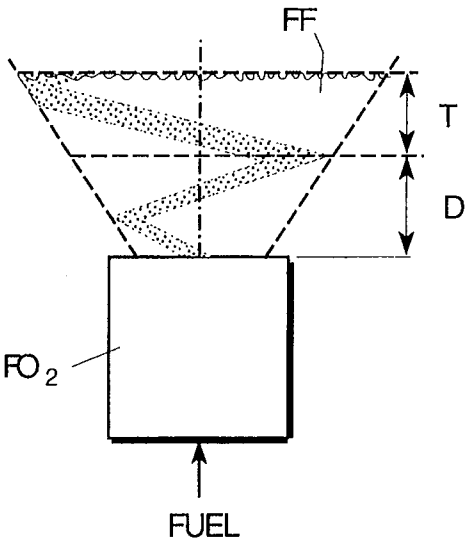
Figure 5C:
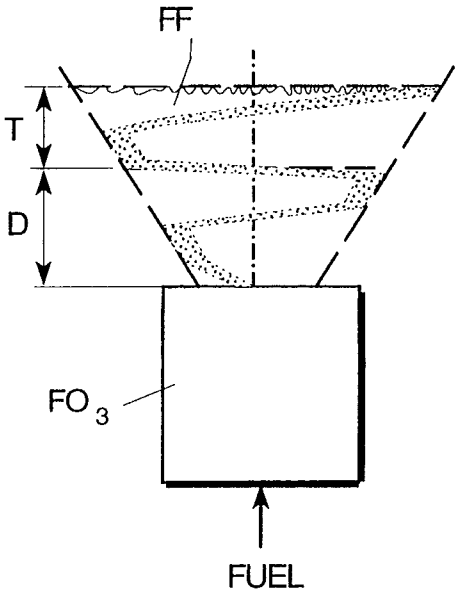
Figure 5E:
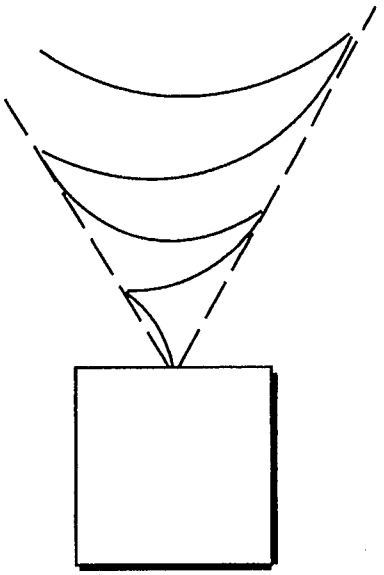
Figure 5D:
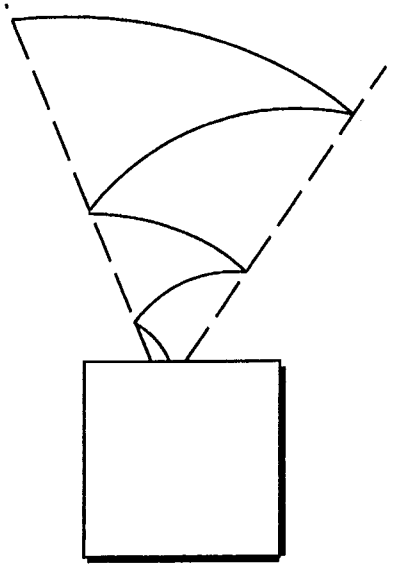

FIGS. 5*a*, 5*b* and 5*c* diagrammatically illustrate the sweeping output from fluidic oscillators FO1, FO2 and FO3. In the oscillator FO1, the end FIG. 5*a*, the oscillator is designed to provide a sinusoidal sweep of the fuel, and if a stop motion strobe is projected on the output stream, the waveform is essentially a sinusoidal shape. In the fluidic oscillator of FIG. 5*b*, the fluidic oscillator FO2 has a triangular-shaped output and in FIG. 5*c*, fluidic oscillator FO3 has a trapezoidal output. That is, there is a dwell resulting in more fuel being mixed with air at its proper fuel-air ratio at the lateral ends of each sweep than in the middle and resulting in a larger flame at those points.

When the fuel rate increases, the velocity of the sweep increases proportionately but the wavelength remains constant and the mixing goes with the frequency, double the frequency, double the mixing rate which means that the proper fuel-air ratio is arrived at a distance closer to the output edges. Thus, the shape of the flame front can be adjusted to accommodate targets and effect a higher heat transfer efficiency while maintaining a relatively cool nozzle. In some cases, the nozzle can be made out of plastic, particularly in those situations where radiant heat from the object being heated is low.

Figure 6D:
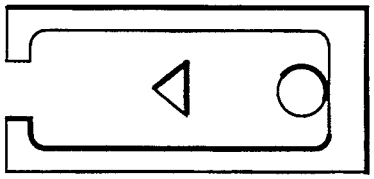
FIG. 6D (PRIOR ART)
Figure 6C:
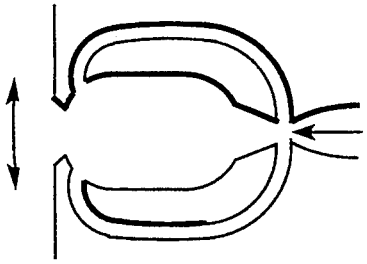
FIG. 6C (PRIOR ART)
Figures 1, 6B:
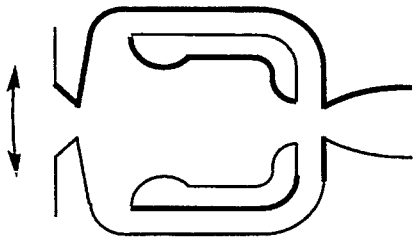
FIG. 6B-1 (PRIOR ART)
Figure 6A:
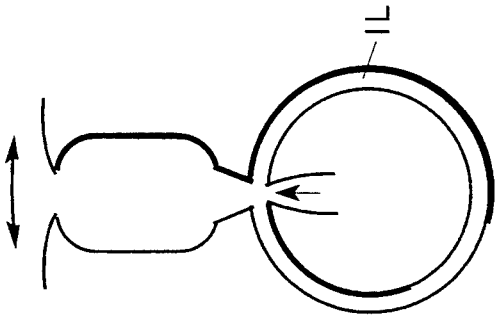
FIG. 6A (PRIOR ART)
Figures 2, 6B:
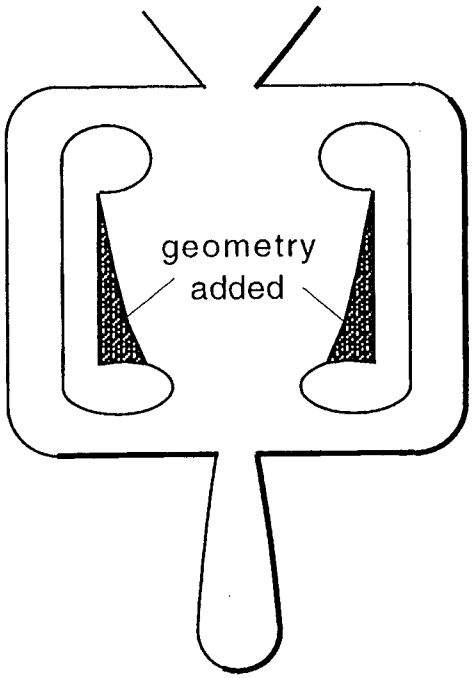
Figure 6F:
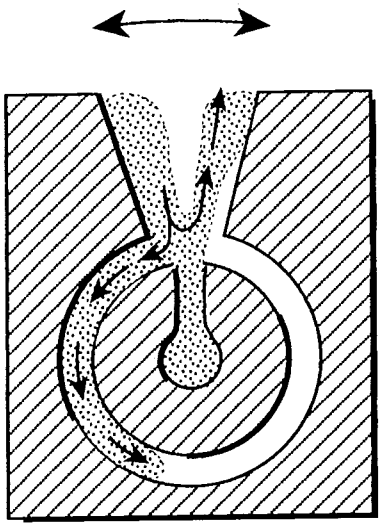
FIG. 6F (PRIOR ART)
Figure 6E:
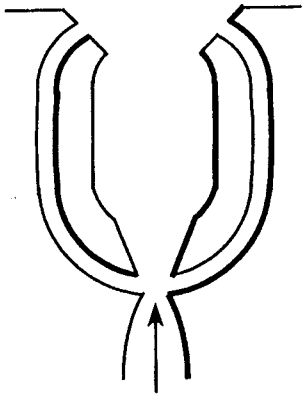
FIG. 6E (PRIOR ART)

In FIGS. 6*a*, 6*b*, 6*c*, 6*d*, 6*e* and 6*f*, there are disclosed various oscillator configurations useful in practicing the invention. In FIG. 6*a*, the oscillator is of the type disclosed in U.S. Pat. No. Re. 33,158 of Stouffer and Bauer entitled "FLUIDIC OSCILLATOR WITH RESONANT INERTANCE AND DYNAMIC COMPLIANCE CIRCUIT" and utilizes an inertance loop IL for oscillation. FIG. 6*b* discloses a fluidic oscillator of the type disclosed in Stouffer U.S. Pat. No. 4,508,267 and depends on the formation and movement of vortices in the chamber to sustain oscillations. FIG. 6*c* discloses an oscillator of the type disclosed in Bray U.S. Pat. No. 4,463,904. The oscillator shown in FIG. 6*d* is an island oscillator of the type disclosed in Stouffer U.S. Pat. No. 4,151,955. In FIG. 6*e*, the oscillator is of the type disclosed in Stouffer and Bray U.S. Pat. No. 4,052,002. In each of these instances, the fluidic oscillator is of the type in which there is a single outlet and the fuel exiting through the outlet of the device seals the oscillator chamber from ambient conditions. In the oscillator shown in FIG. 6*e*, the internal pressure of the device is greater than ambient so that there is always an outflow of fluid.

In FIG. 6*f*, the oscillator is of the type disclosed in the Encyclopedia of Science and Technology (Von Nostrand). In this oscillator type, there is entrainment of ambient air which serves to premix the fuel with air with the fully combustible mixture being arrived through sweeping the fuel jet and at a distance spaced downstream of the edges of the oscillator. This is a less preferred embodiment of the invention because of its dependence on ambient air being drawn into the device itself somewhat in the fashion of the prior art nozzle discussed above. Moreover, because of this entrainment of ambient air, the flame front is spaced closer to the edge of the nozzle and the shape of the frame front is less well controllable. These prior art references are incorporated herein by reference and disclose the operating regimes thereof.

Operation of all fluidic oscillators is characterized by the cyclical deflection of the fuel jet without use of mechanical means of moving parts and consequently, the oscillators are not subject to wear and tear which adversely affects reliability an operation thereof. Moreover, since only the jet and not the entire orifice bearing body is translated, less energy is required to achieve jet oscillation. See Stouffer and Bray U.S. Pat. No. 4,052,002.

Various means can be utilized for varying the frequency of oscillation. For example, in the oscillator shown in FIG. 6*a*, by varying the length of the inertance IL, the frequency can be adjusted.

Figure 7:
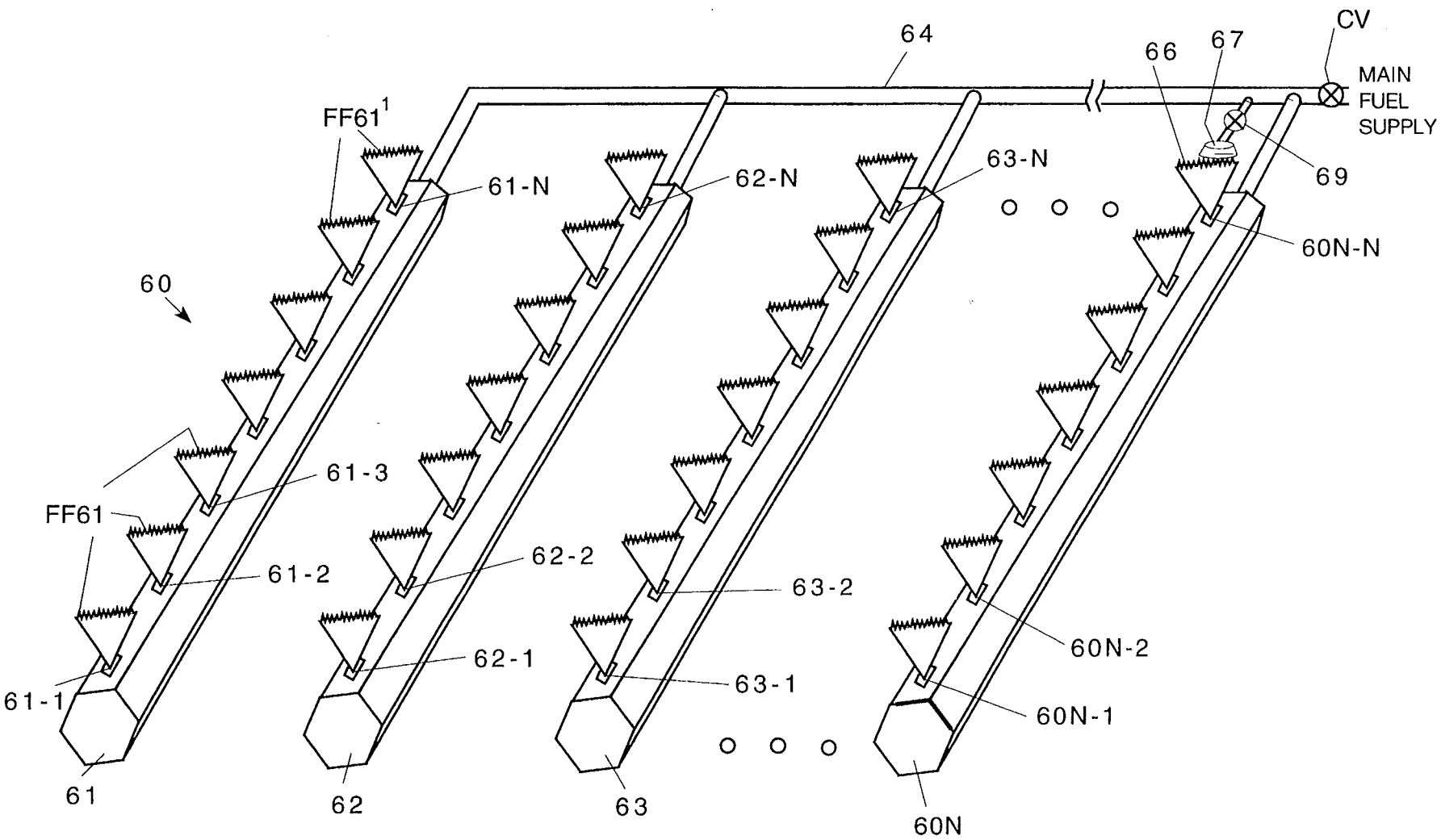
FIG. 7 is a diagrammatic illustration of a furnace burner wherein a plurality of fluidic burner nozzles are arrayed in one or more lines and coupled to one or more fuel manifolds.

In the embodiment shown in FIG. 7, one or more arrays 60 of diagrammatically indicated fluidic oscillators 61-1, 61-2 . . . 61-N, 62-1, 62-2 . . . 62-N, 60N-1, 60N-2, 60N-N on one or more gas fuel manifolds 61, 62, 63 . . . 60N are supplied from a main supply 64 through control valve CV. A pilot flame 96 is supplied with fuel by nozzle 67 which is valved at 69. Any of the types of fluidic oscillator nozzles disclosed herein may be used to oscillate the fuel stream in ambient air to achieve a proper fuel air mixture for the most efficient combustion. In FIG. 7, the broad shaped flame fronts FF61 are spaced from the oscillating nozzles a predetermined distance determined by the sweep angle; wave pattern and frequency of the fluidic oscillators 61-1, 61-2 . . . 60N-1 . . . 60N-N. The operation of the oscillators, such as FIGS. 6*a*, 6*b* and 6*c*, can be synchronized, if desired, by interconnection of their respective feedback paths, for example.

Figure 9:
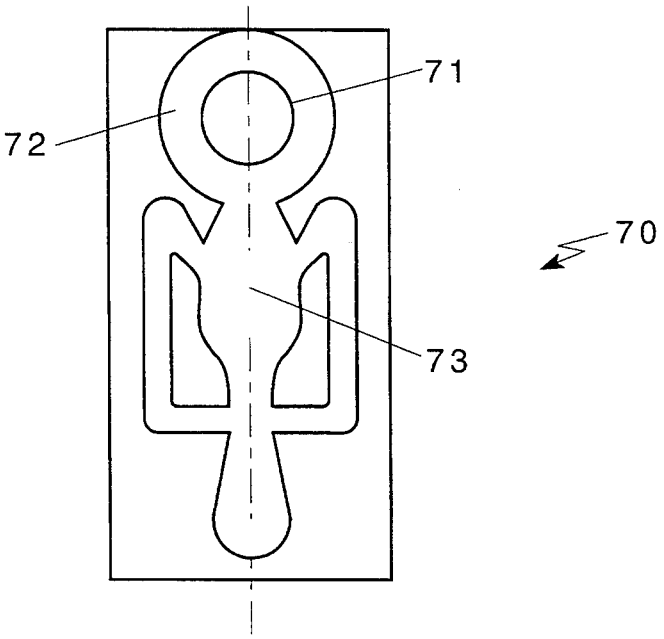
FIG. 9 is a diagrammatic illustration of a fluidic oscillator of the type shown in Stouffer U.S. Pat. No. 4,151,955 for issuing a jet in the form of a sheet of fuel which is oscillated to achieve a combustible air-fuel mixture.

If the oscillators are of the type which issues a sheet of fluid fuel which is oscillated as described above, then the broad flame front will have a significantly larger area. The oscillator silhouette 70 shown in FIG. 9 is of the type shown in the aforementioned Bray patents (but without taper) and is provided with a circular island 71 as shown in FIG. 20 of Stouffer U.S. Pat. No. 4,151,955. In this case, the island 71 has been positioned out of the oscillator interaction region 73 to a generally circular outlet region 72 and produces a swept sheet which is issued to ambient.

Figure 8A:
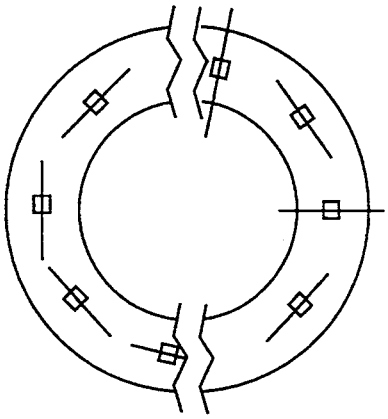
FIGS. 8*a* and 8*b* are diagrammatic illustrations of stove top burners wherein a plurality of fluidic burner nozzles are arrayed in a predetermined pattern such as a circle, or crossed and coupled to a common fuel manifold.
Figure 8B:
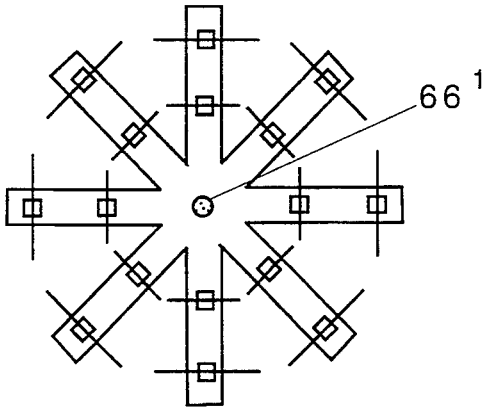

Instead of being in linear array, the oscillator nozzles can be arrayed in a circle as shown in FIG. 8*a* or in transverse crossed array as shown in FIG. 8*b*, which also incudes a pilot flame 66'. Moreover, while it is preferred that the fluidic oscillators be of the same type, there may be cases where the oscillators in one area issue a sweeping jet and in other areas a sweeping sheet is issued.

Figure 11A:
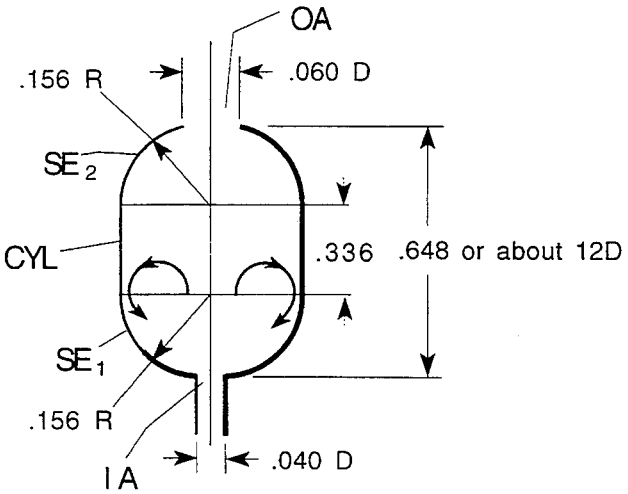
FIG. 11A illustrates a fluidic oscillator in which a toroidal vortex is generated for sweeping the gaseous fuel in a helical path.
Figure 11B:
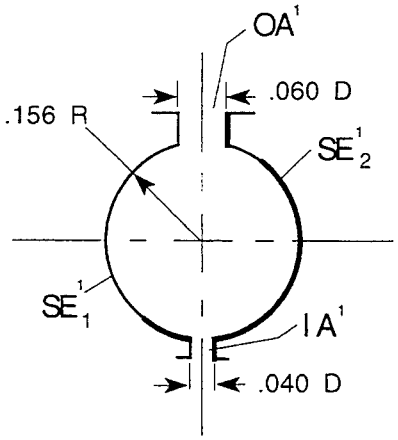
FIG. 11B is a further embodiment of a helical sweep burner.
Figure 11C:
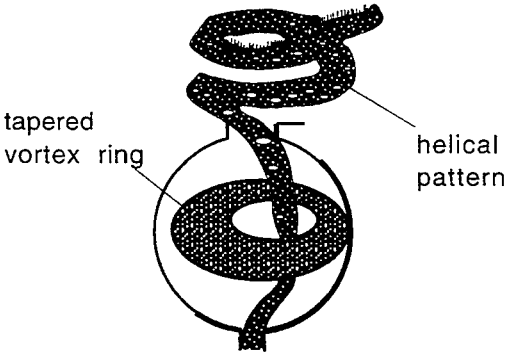
FIGS. 11C–11G are explanatory diagrams of the operation.
Figure 11D:
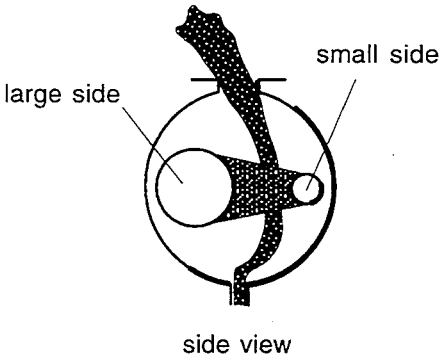
Figure 11E:
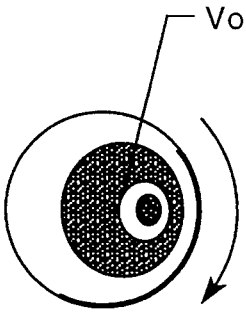
Figure 11F:
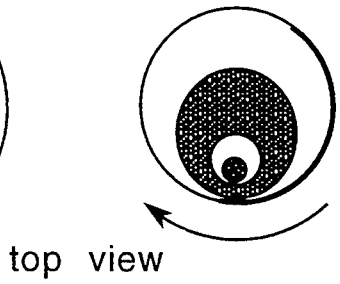
Figure 11G:
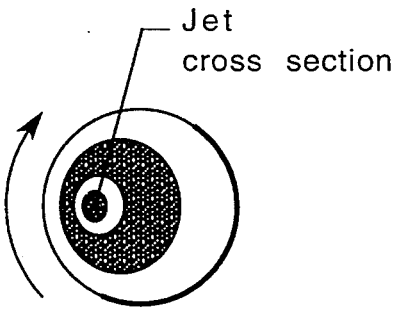

FIG. 11A discloses a preferred device for generating a helical sweeping jet pattern for a gas burner. In this embodiment, a pair of spherically shaped ends SE1 and SE2 are joined by a cylinder CYL to form a figure of refolution about central axis CA. A circular or round input aperture IA is formed in the lower spherical surface and an outlet aperture OA substantially coaxial with the input aperture IA. The dimensions given are exemplary. In a further embodiment, the cylindrical portion can be removed and the two spherically shaped ends joined to form a spherical chamber. In operation, a jet of gaseous fuel issuing through the input aperture or nozzle forms an annular or roll of gas which has a vortical flow direction indicated by the clockwise (right) and counter-clockwise (left) arrows. By virtue of a perturbation, the jet flow deflected toward the wall surface, but is prevented from attaching to any wall surface by the annular vortical flow ring or toroidal vortex. The vortical flow ring grows on one side opposite the direction of deflection, and diminishes on the direction of jet deflection and this condition once initiated travels in a circular path thereby urging the jet in a circular path about the longitudinal axis. This effectively causes the jet issuing through the outlet aperture or opening to sweep in a circular path thereby imparting a helical flow pattern to the jet of fuel. A substantially spherical chamber is illustrated in FIGS. 11A–11G with a diagrammatic illustration of the vortical flow annulus or ring and the helical flow pattern developed thereby.

As disclosed above, the operation of the three-dimensional oscillator differs from its planar cousin (FIGS. 6A–6C and 6E) in that the dual vortex system in the planer version alternate their vortex position on either side of the jet, while the toroidal vortex system in the 3D case shown in FIGS. 11A–11G is a continuous, single, tapered vortex ring which rotates in a plane perpendicular to the jet.

As can be seen from the sketches of FIGS. 11-A–11-G, the toroidal vortex ring has a large cross-section diametrically opposite the smaller cross-section. This causes the jet to bend away from the larger and position closer to the smaller. The larger side having the largest pressure, tends to seek the lower pressure, (smaller side) of the toroidal vortex ring. The migration of the pressure areas interacts with the jet, which is, in turn, supplying energy to the vortex ring, to cause the system to continually rotate about the axis of the interaction region. The jet stays bent, but the plane of the bend is continually rotated so as to cause the jet to exit the interaction chamber in a helical pattern.

This rotation of the toroidal vortex ring does not mean solid body rotation, rather it is like a wave motion where the swollen and contracted portions respectively contact and expand to cause the circumferentially traveling wave.

Figure 12A:
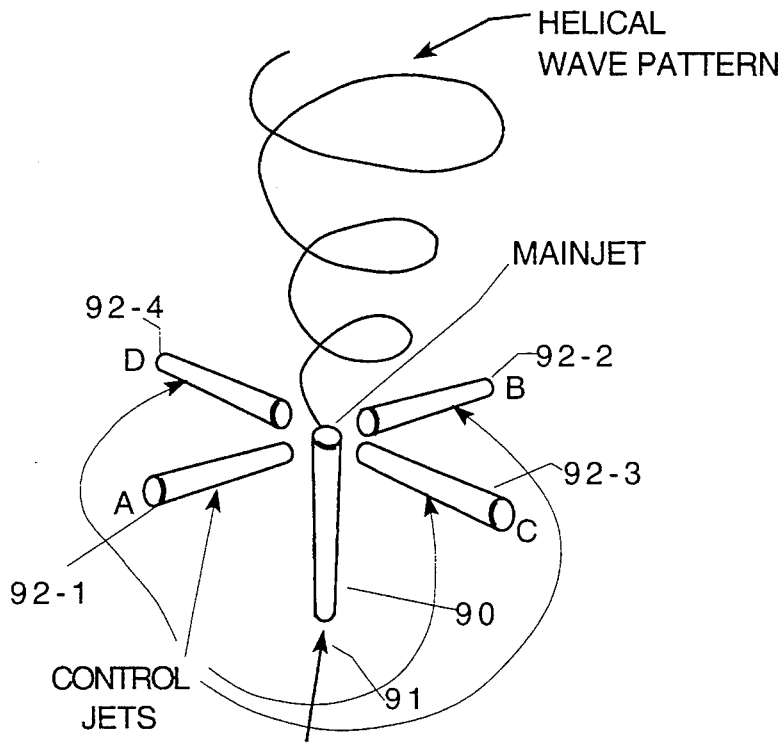
FIG. 12*a* is a diagrammatic illustration of a further embodiment of the invention in which control jets can cause the fuel jet to be swept in ambient air in plurality of complex patterns, (helical being shown)
Figure 12B:
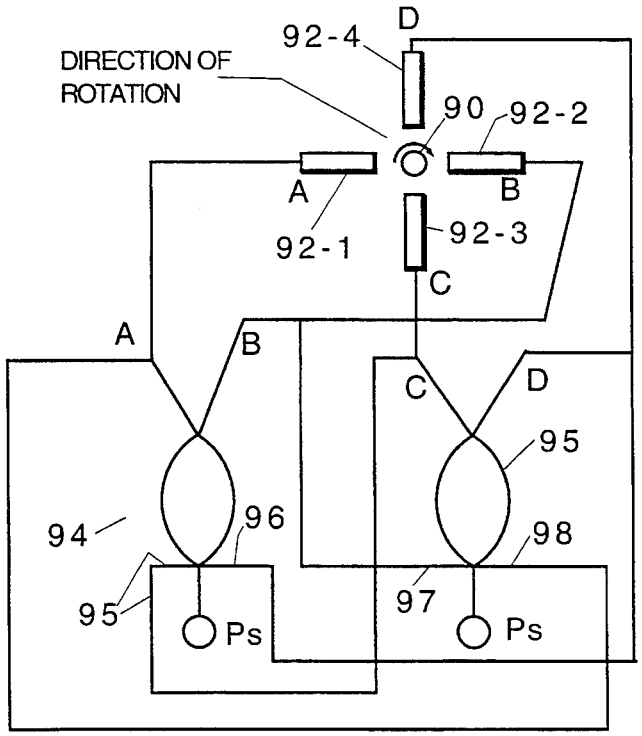
FIG. 12*b* illustrates one control system for the control jets shown in FIG. 12*a*.
Figure 12C:
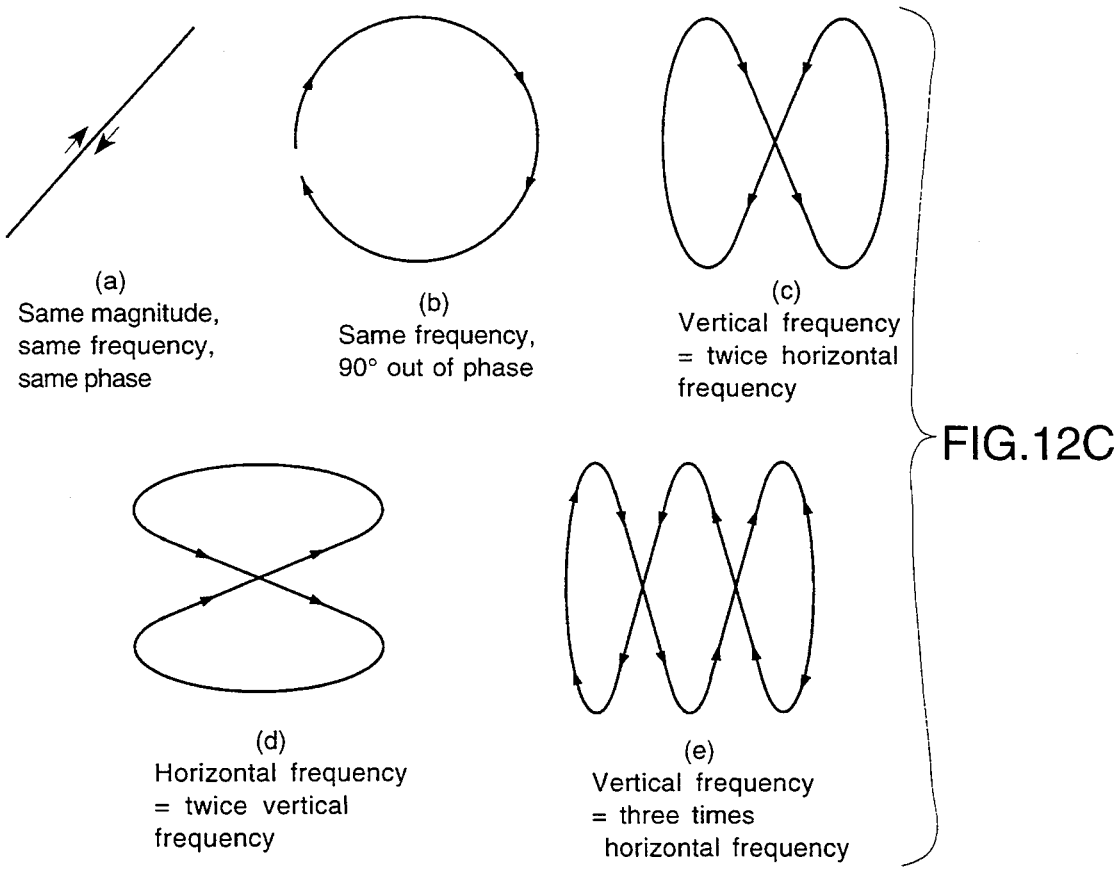
FIG. 12*c* illustrates various sweep patterns used in practice of the invention.

FIGS. 12*a* and 12*b* show systems for producing swept gas jet patterns which are in the nature of the Lissajous figures shown in FIGS. 12C(*a*) . . . 12C(*e*). The more flexible system shown in FIG. 12*a* can be used to create Lissajous patterns shown in FIGS. 12C(*a*)–(*e*). In this embodiment, power nozzle 90 is coupled to a source of fuel 91 under pressure and an array of control jets 92-1, 92-2, 92-3 and 93-4 are coupled to control jet supply, one embodiment of which is shown in FIG. 12*b*, for generating a circular path for the jet resulting in a helical wave pattern for the burner. As shown in FIG. 12*b*, two fluidic amplifier controllers 94 and 95 are connected to the gas supply 91 ($P_s$), and their respective control ports 95, 96, 97 and 98, which produce simple harmonically related outputs are connected so the jet traverses a circular pattern (FIG. 12*c*(*b*). If the control jets 92-1 and 92-2 were connected to be in phase with the signals on control jets 92-3 and 92-4, the sweeping pattern of FIG. 12*c*(*a*) results; if one has twice the frequency as the other, then waveforms of the type shown in FIGS. 12*c*(*c*and *d*) result. FIG. 12*c*(*e*) shows the pattern where the frequency of one control axis signal is three times the frequency of signals on the orthogonal control axis.

It will be appreciated that the control axis signals can be varied from these simple harmonic relationships to tailor the flame front to particular use applications.

In a preferred embodiment of the invention, the burner is provided with a baffle as disclosed in Stuart et al. U.S. application Ser. No. 08/216,522. In a further preferred embodiment of the invention, the burner is provided with an insert which lowers the flame temperature to thereby lower emissions further.

While there has been described and illustrated specific embodiments of the invention, it will be clear that various variations of the details of construction which are specifically illustrated and described may be resorted to without department from the true spirit and scope of the invention as defined in the appended claims.

What is claimed is:

1. A gas burner for heating objects having a supply of gas under pressure which is to be mixed to achieve a combustible mixture, gas flow line connecting to said burner to said supply, a burner means for mixing air with said fluid fuel to achieve said combustible mixture, characterized by said burner means includes one or more jet forming means for issuing one or more jets of said gas having a given cross-sectional area and sweeping said one or more jets of gas in ambient air downstream of said burner means to mix air with said gas and achieve said combustible mixture a distance spaced from any physical structure of said burner means whereby a flame front of burning combustible mixture has a broad shape and is spaced a predetermined distance from said burner.

2. A burner system for mixing fuel with air to attain a combustible fuel-air-mixture, comprising, a nozzle for creating a jet of said fuel and means for oscillating said jet of fuel in the ambient air downstream of said means for oscillating to achieve said combustible fuel-air-mixture at a distance spaced downstream from said means for sweeping.

3. The burner system defined in claim 2 wherein said means for sweeping said jet of fuel is a no-moving part fluidic oscillator.

4. The burner system defined in claim 3 wherein said fluidic oscillator is of the type having an oscillation chamber with single outlet and gas exiting said single outlet seal said oscillation chamber from ambient conditions.

5. The burner system defined in claim 3 including means for varying the frequency of oscillation of said fluidic oscillator.

6. The burner system defined in claim 3 wherein said fluidic oscillator is of the type which depends on the formation and movement of vortices in said gas to sustain oscillation.

7. The burner system defined in claim 3 wherein said fluidic oscillator is of the type which entrains ambient air to premix said gas with entrained air.

8. The burner system defined in any one of claims 2–7 wherein the rate of oscillation of said jet is 1 to 3 Khz.

9. The burner system defined in any one of claims 2–7 wherein said means for oscillating is a fluidic oscillator and said jet is in the form of a gas sheet.

10. In a system for heating objects, said system having a supply of fluid fuel under pressure which is to be stoichiometrically mixed to achieve a combustible mixture, fluid fuel flow line connected to said fluid fuel under pressure, control valve in said fluid fuel flow line, a burner means for mixing air with said fluid fuel to achieve said combustible mixture, characterized by said burner means includes a fluidic oscillator for forming a sheet of said fluid fuel and oscillating said sheet of fluid fuel in ambient air downstream of said fluidic oscillator to mix air with said fuel and achieve said combustible mixture a distance spaced from any physical structure of said burner whereby a flame front of burning combustible mixture has a broad shape and is spaced a distance from said fluidic oscillator which is a function of the cross-sectional area of said nozzle.

11. A gas burner comprising a nozzle means forming a gas jet and means for causing said gas jet to be swept in a pattern and at a rate sufficient to cause 1) the flame to be cooler, 2) NOx emissions to be reduced over a wide firing range, 3) heat efficiency is improved, and (4) the flame to be spaced a distance in ambient air downstream of said burner, such that said nozzle means remains relatively cool.

12. The gas burner defined in claim 11 wherein said jet is formed without the addition of primary and all air for combustion is obtained from ambient.

13. The gas burner defined in claim 11 wherein said means for causing includes one or more fluidic amplifiers.

14. The gas burner defined in claim 11 wherein said means for causing includes a fluidic oscillator.

15. The gas burner defined in claim 11 wherein said means includes one or more control jets oriented at transverse angles to said gas jet and issuing control fluid jets and means to modulate said control fluid jets to create said pattern.

16. The gas burner defined in claim 14 wherein said control fluid jet is of a gas which is to be mixed with said gas jet.

17. The gas burner defined in claim 14 wherein said control fluid jet is air.

18. In a blue flame gas burner having a burner nozzle having an axis, a low cost method of reducing NOx emissions, improving thermal efficiency, causing the flame to burn cooler and keeping the burner nozzle cooler, comprising:

1) forming the gas in a jet along the axis of said nozzle,
2) projecting said jet into ambient air, and
3) causing said jet to sweep in a pattern transverse to said axis and at a predetermined rate.

19. The blue flame gas burner method defined in claim 18 wherein said pattern is caused by oscillating said jet back and forth along a line.

20. The blue flame gas burner method defined in claim 18 wherein said pattern is caused by oscillating said jet along a predetermined path by a set of one or more control jets having an axis transverse to said axis of said nozzle.

21. The blue flame gas burner method defined in one of claims 18–20 wherein combustion is maintained in the absence of adding primary air.

22. The blue flame gas burner defined in claim 18 wherein said pattern is caused by sweeping said jet in a circular pattern.

23. A low emission gas burner having a combustion zone comprising, means for forming a jet of gas and means for sweeping said jet in a circular pattern to form a helical jet pattern in advance of said combustion zone.

24. The gas burner defined in claim 23 wherein said means for sweeping includes a chamber having input and output apertures which are substantially coaxially aligned, and spherically shaped surfaces contiguous to said input and output apertures, respectively.

25. The gas burner defined in claim 24 wherein said chamber includes a cylindrical surface joining said spherically shaped surfaces.

26. The gas burner defined in claim 23 wherein said means for sweeping includes a plurality of control jet deflection nozzles adjacent said means for forming a jet and phased and oriented to cause said jet to sweep in said circular patterns.

27. In a system for heating objects, said system having a supply of fluid fuel under pressure which is to be stoichiometrically mixed with air to achieve a combustible mixture, a fluid fuel flow line connected to said supply of fluid fuel under pressure, control valve in said fluid fuel flow line, a burner means for mixing air with said fluid fuel to achieve said combustible mixture, characterized by said burner mean includes a plurality of fluidic oscillators, each fluidic oscillator issuing a jet of said fluid fuel in a predetermined direction and causing said jet of fluid fuel sweep in ambient air downstream of said combustible mixture a distance spaced from any physical structure of said burner whereby a flame front of burning combustible mixture is spaced a distance from each said fluidic oscillator, respectively.

28. The system for heating objects as defined in claim 27 wherein said plurality of fluidic oscillators are in an array having a predetermined pattern.

* * * * *